US005153562A

United States Patent [19]

van Breemen

[11] Patent Number: 5,153,562

[45] Date of Patent: Oct. 6, 1992

[54] METHOD AND APPARATUS FOR DEACTIVATING ELECTROMAGNETIC DETECTION LABELS

[75] Inventor: Paulus J. W. M. van Breemen, Enschede, Netherlands

[73] Assignee: N.V. Nederlandsche Apparatenfabriek Nedap, De Groenlo, Netherlands

[21] Appl. No.: 645,886

[22] Filed: Jan. 25, 1991

[30] Foreign Application Priority Data

Jan. 25, 1990 [NL] Netherlands ..... 9000186

[51] Int. Cl.[5] ..... G08B 13/14

[52] U.S. Cl. ..... 340/572; 340/825.14; 340/825.72

[58] Field of Search ..... 340/572, 825.14, 825.2, 340/825.72

[56] References Cited

U.S. PATENT DOCUMENTS

| | | | |
|---|---|---|---|
| 3,810,147 | 5/1974 | Lichtblau | 340/572 |
| 4,567,473 | 1/1986 | Lichtblau | 340/572 |
| 4,728,938 | 3/1988 | Kaltner | 340/572 |
| 4,876,555 | 10/1989 | Jorgensen | 340/572 X |
| 4,906,974 | 3/1990 | Rehder | 340/572 X |
| 4,920,335 | 4/1990 | Andrews | 340/572 |
| 5,012,225 | 4/1991 | Gill | 340/572 |

*Primary Examiner*—Jin F. Ng
*Assistant Examiner*—Thomas J. Mullen, Jr.
*Attorney, Agent, or Firm*—Fleit, Jacobson, Cohn, Price, Holman & Stern

[57] ABSTRACT

A method of deactivating electromagnetic detection labels comprising a resonant circuit, in which an interrogation field is generated, the frequency of which is varied through a frequency range comprising the resonant frequency of the resonant circuit of the detection label, and in which a label is deactivated with an amplified interrogation field. According to the invention, the frequency of the interrogation field is continuously and periodically varied between a first and a second frequency; upon detection of a detection label, the resonant frequency of the label is detected, and at at least one of the subsequent times the periodically varying frequency passes the detected frequency, the field intensity at the location of the detection label is greatly increased for a short period of time. Apparatus for deactivating detection labels comprises a transmitter/receiver comprising a transmitter/receiver circuit for generating an interrogation field with a continuously and periodically varying frequency, and determining at what value of the varying frequency a label is detected; and a circuit for greatly increasing the field intensity for a short period of time at one or more moments when the value of the varying frequency is again reached.

9 Claims, 1 Drawing Sheet

METHOD AND APPARATUS FOR DEACTIVATING ELECTROMAGNETIC DETECTION LABELS

BACKGROUND OF THE INVENTION

This invention relates to a method of deactivating electromagnetic detection labels comprising a resonant circuit, in which an interrogation field is generated, the frequency of which is varied through a frequency range comprising the resonant frequency of the resonant circuit of the detection label, and in which a label is deactivated with an amplified interrogation field. The invention further relates to apparatus for deactivating electromagnetic detection labels comprising a resonant circuit, which apparatus comprises a transmitter/receiver with an antenna for generating an interrogation field, and means for generating a field amplified to a deactivating level. The invention also relates to an electromagnetic detection system comprising at least one detection zone in which, in operation, by means of one or more transmitters/receivers, an electromagnetic interrogation field can be generated for detecting detection labels comprising a resonant circuit, and a plurality of deactivating devices in which, in operation, detection labels can be detected and deactivated by means of a transmitter/receiver.

Electromagnetic detection labels, sometimes referred to as wafers or detection platelets, can be used in many situations for detecting the presence, and often also the identity, of a person, animal, vehicle, article, etc., in a detection zone. An important use for such detection labels is in shop-lifting detection systems. In such an application, each article to be protected is provided with a detection label which comprises a resonant circuit. Detection zones are formed near the exits of the shops, where an electromagnetic a.c. field, sometimes referred to as an interrogation field, is generated with the resonant frequency of the electromagnetic labels. Often, use is made of a sweep field, i.e., an interrogation field whose frequency varies periodically at a pre-determined rate between an upper and a lower limit. The resonant frequency of the labels is then intermediate these limits. As soon as a label is in a detection zone, the resonant circuit of the label is brought into the resonant state by the electromagnetic field. This fact can be detected either on the basis of the energy absorption caused by it, or on the basis of the secondary field formed by the label proper.

The labels are normally removed by a shop assistant at the cash desk, as soon as the protected goods have been paid for. In that case the labels do not reach the detection zone. If, however, it is attempted to take the goods outside without paying for them, the labels, which are mostly attached to the goods in a special way, are not removed. Such unremoved labels are detected in the detection zone, whereafter a signal can be given which reminds the customer of his obligation to pay.

The labels removed by the shop assistant at the cash desk are often designed for re-use. Alternatively, labels are sometimes designed to be used once only. Such labels could be removed at the cash desk, or could simply be deactivated, i.e. modified so that the deactivated labels can be carried through a detection zone without being detected. Deactivation should preferably be effected in a contactless manner, which offers the possibility of attaching the detection labels at a place which is difficult of access. Furthermore, a contactless and preferably also automatic deactivation promotes fast handling at the cash desk.

Such deactivatable labels can take the form, for example, of stickers.

In order that deactivatable labels may actually be deactivated, it is necessary for the characteristics of the resonant circuits of the labels to be modified in such a manner that the labels can no longer be detected. Known possibilities therefor are, for example, detuning the resonant frequency of the circuit to outside the detection range; changing the quality factor Q of the circuit to a low value; interrupting the circuit, or short-circuiting the circuit. To effect the change in characteristics, mostly one of the following two principles is used:

1. Dielectric breakdown in the capacitor of the circuit, resulting in a permanent short-circuit or decrease in quality factor;

2. The permanent interruption of the circuit by causing a fuse included in the circuit to blow.

Method 1 requires a high voltage to be generated across the capacitor. In method 2, however, a high current must flow through the circuit. In both cases, a much higher electromagnetic field intensity is needed than the field intensity normally used to detect the presence of a label. The maximum energy is transmitted to the resonant frequency of the label. Devices to realize this are known by the name of "deactivators". A deactivator of the above kind is disclosed in U.S. Pat. No. 4,567,473. The known deactivator comprises means for generating, in a limited region, an electromagnetic field with a frequency which, to a certain extent, is varied around the resonant frequency of the labels. Furthermore, means are provided in the deactivator to detect the presence of a label in the region, as well as the resonant frequency of the label. When the deactivator has determined the presence and the resonant frequency of a label, such a strong field is generated with the resonant frequency in question that the resonant properties of the label are permanently disabled. The detection system is also active during the increased field intensity, and as soon as the label is no longer detected, and so the resonant circuit has been disabled, the field intensity is returned to the normal detection level. In an alternative method, also described in U.S. Pat. No. 4,567,473, use is made of a field with an increased field strength and a swept frequency. One disadvantage of this is that the bandwidth of a label is generally about 10% of the frequency sweep. During about 90% of the deactivating period, therefore, a large field is generated unnecessarily, which involves a number of disadvantages. Thus, for example, the operator of the deactivator is subjected to a relatively high biological load with a high-frequency electromagnetic field. Also, the prior apparatus has an unnecessarily high power consumption. Furthermore, both existing methods often result in spurious radiation as a result of the strong non-synchronized deactivating fields, which may cause interference with interrogation fields generated elsewhere, resulting in false alarm or a reduced chance of detection of the labels.

SUMMARY OF THE INVENTION

It is an object of the present invention to overcome the disadvantages outlined above, and, generally, to provide an effective and reliable method and apparatus for deactivating electromagnetic detection labels.

According to the present invention, a method of the above-described type is characterized in that the frequency of the interrogation field is continuously and periodically varied between a first and a second frequency; that, upon detection of a detection label, the resonant frequency of the label is detected, and that at least one of the subsequent times the periodically varying frequency passes the detected frequency, the field intensity at the location of the detection label is greatly increased for a short period of time.

An apparatus for deactivating electromagnetic detection labels of the above kind is characterized, in accordance with the present invention, in that the transmitter/receiver comprises means for generating an interrogation field with a continuously and periodically varying frequency, detection means capable of determining at what value of the varying frequency a label is detected; and means for greatly increasing the field intensity for a short period of time at one or more moments when the said value of the varying frequency is again reached.

A detection system of the above kind is characterized, in accordance with the present invention, by a central synchronizer coupled with all transmitters/-receivers of the detection zones and with the deactivators, and supplies synchronization signals thereto for causing the interrogation/deactivation fields which in operation are generated by said transmitters/receivers to be varied in frequency periodically and continuously and in synchronism.

DETAILED DESCRIPTION OF THE DRAWINGS

Figure 1:
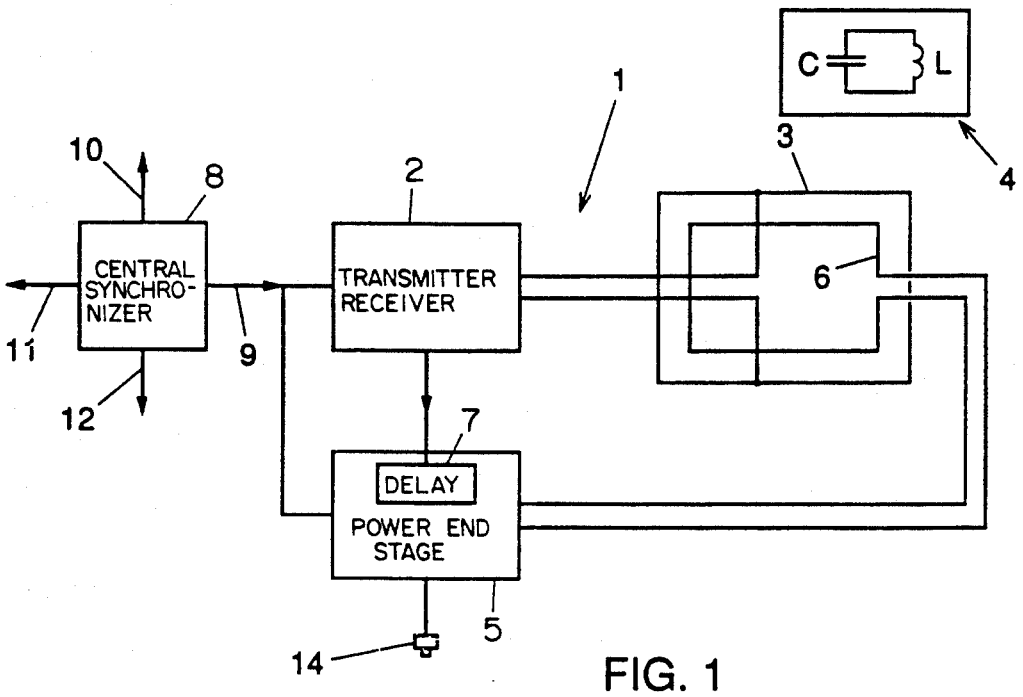
FIG. 1 shows diagrammatically an embodiment of an apparatus according to the present invention.

FIG. 1 shows diagrammatically a deactivator 1 comprising a transmitter/receiver 2 including an antenna 3 by means of which an electromagnetic interrogation field can be generated in a limited region. The frequency of the interrogation field is continuously and periodically varied in known manner, for example, by using a VCO (voltage-controlled oscillator) not shown, between a first and a second frequency. This sweep frequency is shown diagrammatically in FIG. 2. The frequency f0 of the interrogation field varies periodically and continuously between a lowest frequency f1 and a highest frequency f2. In the example shown, the frequency f0 varies sinusoidally, but any other form of gradual variation, for example, according to a triangular or sawtooth from is in principle possible. The frequency range f1–f2 comprises the resonant frequency f3 of the resonance circuit LC of the labels used, as the label shown diagrammatically at 4. In other words, the frequency f3 is within the frequency sweep range.

When a label 4 is within the field formed by antenna 3, the resonant circuit LC of the label is brought into the resonant state when the frequency of the field has the value f3. At that moment, the presence of the label is detected in known manner. Moreover, the resonant frequency of the label is then known, as it corresponds to the instantaneous value of the field frequency.

The detection of a label can be effected on the basis of the voltage prevailing across antenna 3, which decreases as soon as the resonant circuit of the label is in the resonant state. It is also possible to detect the signal transmitted by the label by means of a separate receiving antenna and a receiver coupled therewith. In the example shown, the presence of a label is detected by the transmitter/receiver 2, which upon detecting a label supplies a control signal, for example, a control pulse, to a power end stage 5. In the example shown, the power end stage 5 is connected to a separate antenna 6, which in the vicinity of label 4 can generate an amplified field with the resonant frequency of the label in question. The amplified field has such a high intensity that the electrical characteristics of the label are modified so as to disable the label. To this effect, the resonant circuit of the label may comprise an easily fusable conductor portion and/or a capacitor which breaks down at an elevated voltage.

Figure 2:
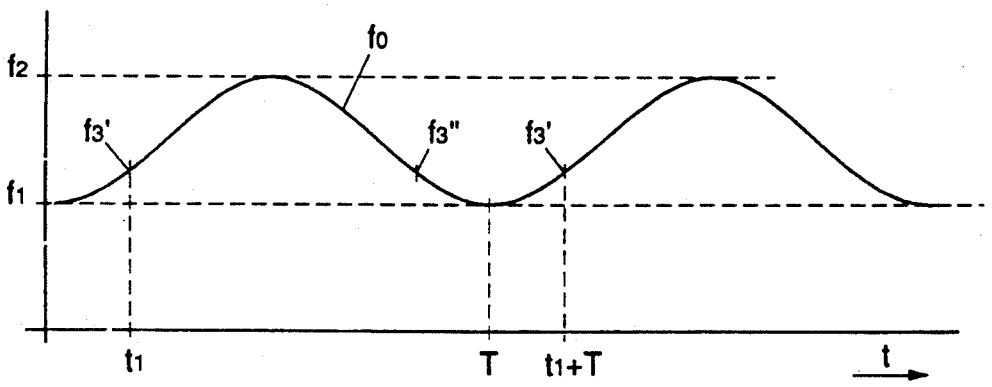
FIG. 2 illustrates a signal sweeping in frequency.

FIG. 2 shows, by way of example, a resonant frequency f3' of a detected label. The label in question has been detected at time t, after the beginning of a periodical frequency sweep. The frequency of the detected label is stored in one way or another, either directly or indirectly, and either by digital or analog means. The cycles of frequency sweeps are continued without interruptions. As soon as the swept frequency of, for example, a whole cycle or a number of whole cycles of the swept frequency again reaches the value of the stored frequency, then, as stated before, the intensity of the interrogation field at label 4 is greatly increased.

In the example shown, for this purpose, use is made of the control pulse referred to hereinbefore, which is supplied by transmitter/receiver 2 to the power end stage 5 upon the detection of a label. The power end stage comprises a delay device 7 which in the example shown, after one cycle T of the frequency sweep provides a signal which controls the power end stage in such a manner that the latter energizes antenna 6 with a strong signal. Antenna 6 thus forms a strong electromagnetic field at label 4. In the example described, therefore, the label is deactivated at time t1 +T.

The interrogation field is amplified and then attenuated within the bandwidth of the label, which requires no more than a few milliseconds for one burst. If, however, the first burst has not deactivated the label, the label is again detected in a next frequency sweep, and the burst can be generated again.

Figure 3:
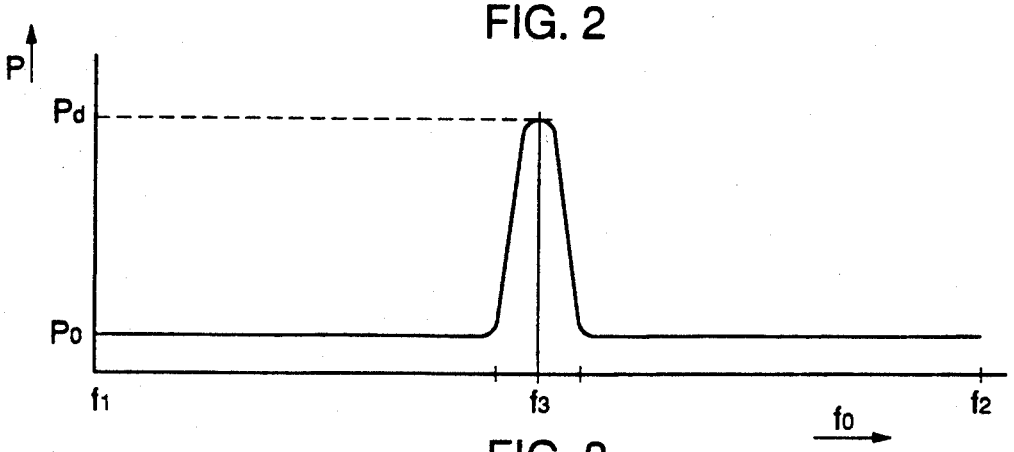
FIG. 3 shows diagrammatically the relationship between the field intensity of an interrogation/deactivation field and the sweep frequency.

FIG. 3 shows diagrammatically the relationship between the sweep width and the power generated. The transmitter/receiver 2 of the deactivator remains at the—limited—detection level $P_0$ during the first part of the sweep, and detects a label with a given frequency f3. This frequency is stored. After one or more cycles T, f3 is again passed. During this passage, the field intensity of the interrogation field is suddenly greatly increased until the deactivating level Pd is reached, whereafter the field strength is again attenuated to the detection level.

By maintaining a continuous frequency sweep, also during the increased field intensity, the deactivator can continue to be synchronized with other interrogation fields of the (shop-lifting) detection system, as well as with any other components of the detection system which may be provided. As a consequence, no spurious signals can occur which normally are the result of the interruption of the frequency sweep or a non-synchronized frequency sweep. Furthermore, the burst is limited to the bandwidth of the label, which has a favourable effect on both current consumption and the biological effect of electromagnetic radiation.

FIG. 1 shows at 8 diagrammatically a central synchronizer which through a plurality of outputs 9–12 supplies synchronization signals to the various detectors and deactivators of a detection system. The synchronization signals may consist, for example, of a centrally generated periodic swept-frequency signal which, where necessary, may be provided at the various outputs with suitable phase differences in order to take into account the various distances of the detection and deactivation apparatuses from the central synchronizer.

It is observed that, after reading the above, various modifications will readily occur to those skilled in the art. Thus devices 2 and 5 may be integrated to form one single apparatus, and also it would be possible to use one single antenna for both detecting a label and deactivating a label.

The delay device may be an analog delay line but, alternatively may be a digital delay device comprising, for example, a counter or a shift register, as well as a suitable clock pulse generator which preferably is phase-locked with the swept frequency.

Furthermore, the deactivator may be arranged so that the field intensity is not increased until after the presence of the label has been detected a pre-determined minimum number of times. Also, if desired, a label detected during the rising part of a frequency sweep may already be deactivated during the next descending part of the sweep, as shown in FIG. 2 at f3″. Furthermore, means as shown at 14 in FIG. 1 may be provided for manually switching on the amplified field in case a label cannot be deactivated in the normal manner.

These and similar modifications are considered to fall within the scope of the present invention.

I claim:

1. In a method of deactivating electromagnetic detection labels having a resonant circuit, in which an interrogation field is generated, the frequency of which is varied through a frequency range comprising the resonant frequency of the resonant circuit of a detection label, and in which the label is deactivated with an amplified interrogation field, the improvement comprising the steps of periodically varying the frequency of the interrogation field over a frequency range including the resonant frequency of the label, detecting the resonant frequency of the label and subsequently substantially increasing the field intensity of the interrogation field at the location of the detection label for a short period of time coincident with at least one of the subsequent times that the periodically varying frequency passes the detected frequency, wherein the increased field intensity is generated at one or more instants subsequent to one or more periods of the varying frequency of the interrogation field after the instant the resonant frequency is detected.

2. A method as claimed in claim 1, and further comprising the step of determining the instants when the field intensity is increased by means of a delay device.

3. A method as claimed in claim 1, wherein the field intensity is not increased until after the label has been detected during a pre-determined minimum number of periods of the varying frequency.

4. A method as claimed in claim 1, and further comprising the steps of checking whether a label detectable with the interrogation field is present after the field intensity has been greatly increased one or more times and increasing the field intensity one or more times at the resonant frequency of the label when the detectable label is present.

5. In an electromagnetic detection system comprising at least one detection zone in which, in operation, by means of one or more transmitters/receivers, an electromagnetic interrogation field is generated for detecting detection labels comprising a resonant circuit, and a plurality of deactivating devices in which, in operation, detection labels are detected and deactivated by means of a transmitter/receiver, the improvement wherein the transmitter/receiver comprises means for generating an interrogation field with a continuously varying frequency, which frequency is varied periodically, and detection means capable of determining at what value of the varying frequency of the interrogation field a label is detected; said improvement further comprising means for substantially increasing the field intensity for a short period of time at one or more instants when the label detection value of the varying frequency is again reached, said means for increasing comprising a power end stage and a delay device for switching on the power end stage a pre-determined time after a label has been detected, said predetermined period of time being equal to the period of the periodically varying frequency.

6. Apparatus as claimed in claim 5, wherein said delay device is a digital delay device.

7. Apparatus as claimed in claim 5, and further comprising an antenna connected to the power end stage.

8. Apparatus as claimed in claim 5, and further comprising a manual switch for the power end stage.

9. In an electromagnetic detection system comprising at least one detection zone in which, in operation, by means of one or more transmitters/receivers, an electromagnetic interrogation field is generated for detecting detection labels having a resonant circuit, and a plurality of deactivating devices in which, in operation, detection labels are detected and deactivated by means of a deactivation field, the improvement comprising a central synchronizer coupled with all transmitters/receivers of the detection zones and with the deactivating devices, for supplying synchronization signals thereto for causing the interrogation and deactivation fields generated by said transmitters/receivers and deactivating devices to vary in frequency periodically and in synchronism.

* * * * *